United States Patent [19]

Duvlis

[11] Patent Number: 4,742,764

[45] Date of Patent: May 10, 1988

[54] METHOD AND APPARATUS FOR INSULATING SELECTED AREAS FROM THE SURROUNDING ATMOSPHERE WITH CLEAN-ROOM AIR

[76] Inventor: Zinon Duvlis, Burgdorfer Damm 5, D-3000 Hanover, Fed. Rep. of Germany

[21] Appl. No.: 766,153

[22] Filed: Aug. 15, 1985

[30] Foreign Application Priority Data

Aug. 16, 1984 [DE] Fed. Rep. of Germany ..... 3430089

[51] Int. Cl.[4] ..... F24F 9/00

[52] U.S. Cl. ..... 98/36; 128/1 R

[58] Field of Search ..... 98/36; 128/1 R, 1 B, 128/402

[56] References Cited

U.S. PATENT DOCUMENTS

| | | | |
|---|---|---|---|
| 2,062,187 | 11/1986 | Morrison | 98/36 X |
| 2,754,746 | 7/1956 | O'Brien | 98/36 |
| 3,051,180 | 8/1962 | Adams-Ray et al. | 128/402 X |
| 3,505,989 | 4/1970 | Truhan | 98/36 X |
| 3,893,457 | 7/1975 | van der Waald | 98/36 X |
| 3,923,482 | 12/1975 | Knab et al. | 98/36 X |
| 4,063,495 | 12/1977 | Duvlis | 128/1 R X |

*Primary Examiner*—William E Wayner

*Attorney, Agent, or Firm*—Peter K. Kontler

[57] ABSTRACT

A selected part of or the entire body of a patient on an operating table can be insulated from air in the surrounding atmosphere by a stream of clean-room air which issues from a distributor head and is caused to form a relatively thin layer between the selected part and the surrounding atmosphere. Such relatively thin layer can be established and maintained by heating or cooling the stream so that its temperature deviates from that of air in the surrounding atmosphere by a few degrees centigrade. The direction of flow of a portion of or the entire stream can be changed by one or more secondary streams. The moisture content of the stream of clean-room air can be increased by causing it to flow through a steam chamber. Heating or cooling of the stream can precede or follow sterilization of atmospheric air which is to form the stream.

34 Claims, 5 Drawing Sheets

METHOD AND APPARATUS FOR INSULATING SELECTED AREAS FROM THE SURROUNDING ATMOSPHERE WITH CLEAN-ROOM AIR

BACKGROUND OF THE INVENTION

The present invention relates to a method and to an apparatus for shielding selected areas from microorganisms and/or contaminants, and more particularly for insulating selected areas (especially areas occupied by parts of or entire bodies of patients on operating tables) from the surrounding atmosphere.

It is known to insulate the area above the operating table from the surrounding atmosphere by so-called clean-room air. To this end, clean-room air is discharged by one or more nozzles to flow, e.g., substantially tangentially, along the outline of the selected area. Apparatus for converting atmospheric air into clean-room air are still in a stage of continuous development, the same as the devices for controlling the flow of clean-room air around the selected area so as to insulate such area from the surrounding atmosphere. Heretofore known apparatus and methods are unsatisfactory in numerous respects, especially as concerns the economy of generation and utilization of clean-room air and also as concerns the prevention of penetration of infectants from the surrounding atmosphere into the selected area, e.g., into the region adjacent to that part of the body of a patient on an operating table or in an emergency room which is to undergo surgery and/or other treatment.

OBJECTS AND SUMMARY OF THE INVENTION

An object of the invention is to provide a novel and improved method of generating and utilizing clean-room air in hospitals, clinics, sanitaria and similar establishments.

Another object of the invention is to provide a novel and improved method of treating clean-room air in such a way that relatively small quantities of clean-room air suffice for effective insulation of a selected area from the surrounding atmosphere.

A further object of the invention is to provide a method which renders it possible to prevent clean-room air from withdrawing moisture from the selected area if the withdrawal of moisture is undesirable or harmful to a patient.

An additional object of the invention is to provide a novel and improved method of compelling clean-room air to flow in one or more desired directions without the danger of contamination.

Still another object of the invention is to provide a method which can be practiced in connection with all kinds of existing operating tables and like supports for parts of or entire bodies of humans or animals.

A further object of the invention is to provide a novel and improved method of treating clean-room air prior to introduction of such air between a selected area and the surrounding atmosphere.

Another object of the invention is to provide a novel and improved apparatus for the practice of the above outlined method and to provide the apparatus with novel and improved means for generating and treating clean-room air.

Still another object of the invention is to provide the apparatus with novel and improved means for selecting and regulating the direction of flow of clean-room air in an operating room or the like.

A further object of the invention is to provide the apparatus with novel and improved means for influencing the temperature of clean-room air or of air which is to be converted into clean-room air.

An additional object of the invention is to provide the apparatus with novel and improved means for influencing the moisture content of clean-room air or of air which is to be converted into clean-room air.

Another object of the invention is to provide novel and improved operating room or emergency room equipment which embodies the above outlined apparatus.

A further object of the invention is to provide the apparatus with novel and improved means for permitting a rapid and convenient changeover from a first type of treatment to one or more different types of treatment of clean-room air or of air which is to be converted into clean-room air.

An additional object of the invention is to provide the apparatus with novel and improved means for influencing several characteristics of clean-room air in a small area and with a small number of simple and inexpensive instrumentalities.

Another object of the invention is to provide a highly mobile apparatus which can be readily transported to and from the locale of use or storage.

An additional object of the invention is to provide an apparatus which can be assembled of several modules so that its complexity and bulk match the requirements in the operating or emergency room of a hospital, clinic, sanitarium, senior citizens' home or an analogous establishment.

One feature of the present invention resides in the provision of a method of at least partially insulating a selected area from the surrounding atmosphere, especially of insulating the area which is occupied by a part of or the entire body of a patient on an operating table. The method comprises the steps of establishing a stream of clean-room air between the selected area and the surrounding atmosphere, and thermally stabilizing or conditioning the stream.

The stabilizing step can comprise the step of maintaining the temperature of the stream below the temperature of air surrounding the selected area. This can be accomplished by cooling the stream prior or subsequent to sterilization of atmospheric air which is to form the stream of clean-room air. Alternatively, the stabilizing step can include maintaining the temperature of the stream above the temperature of air which surrounds the selected area. This can be accomplished by heating the stream prior or subsequent to the sterilizing step.

The establishing step can comprise conveying the stream along a predetermined path, and the method can further comprise the step of diverting at least a portion of the stream from the path, e.g., at one end and/or at one or both sides of the selected area. The diverting step can comprise establishing a second stream of clean-room air (secondary stream) and directing the secondary stream against the aforementioned portion of or the entire stream in the predetermined path. The directing step can comprise conveying the secondary stream along a second path which makes with the first path a predetermined angle (e.g., an angle of approximately or exactly 90 degrees). The secondary stream can be conveyed substantially transversely of the predetermined path.

The secondary stream can at least partially confine the stream in the predetermined path, and the two streams can be maintained at different or identical temperatures. For example, the secondary stream can be heated or cooled so that its temperature rises to or above or drops to or below that of the stream in the predetermined path. Anologously or in addition thereto, the stream in the predetermined path can be heated or cooled so that its temperature matches, exceeds or is less than that of the secondary stream.

The method can further comprise the step of moisturizing the stream of clean-room air which is to be conveyed between the selected area and air in the atmosphere surrounding such area. The moisturizing step can include contacting the stream with steam or with a body of liquid (e.g., water in liquid form or in the form of fragments of ice). The moisturizing step can precede or follow the step of sterilizing atmospheric air which is to form the stream of clean-room air in the predetermined path.

Another feature of the invention resides in the provision of an apparatus for insulating a selected area from the surrounding atmosphere, particularly for insulating the area which is occupied by a part of or the entire body of a patient on an operating table. The apparatus comprises means for establishing a stream of clean-room air between the selected area and the surrounding atmosphere, and means for thermally stabilizing the stream. The means for establishing the stream can include means for directing the stream substantially tangentially of the selected area.

The stabilizing means can comprise means for maintaining the temperature of the stream above or below the temperature of air in the surrounding atmosphere. In accordance with one presently preferred embodiment of the invention, the stabilizing means comprises means for cooling the stream, and such cooling can take place upstream or downstream of the location where atmospheric air is sterilized (e.g., by flowing through a suitable filter) in order to be converted into clean-room air. Alternatively, the stream can be heated upstream or downstream of the filter or filters. The means for establishing the stream of clean-room air includes means for conveying the stream along a predetermined path, and the heating or cooling means of the stabilizing means can be installed in or adjacent to a selected portion of such path. The conveying means can draw atmospheric air into the path and can force the thus drawn air to flow through one or more filters or other sterilizing means serving to convert atmospheric air into clean-room air.

The stabilizing means can comprise at least one heat exchanger including one or more tubular components whose external surfaces are contacted by air upstream or downstream of the filter or filters and which confine a suitable heat exchange medium (conditioning fluid) serving to withdraw heat from or to transmit heat to the stream of air. For example, the heat exchanger can be designed to effect an exchange of heat between air and a body of water.

The stabilizing means can comprise a refrigerating system with a compressor, a condenser, a supply of refrigerant which expands in response to an exchange of heat with the stream, and means for withdrawing heat from the refrigerant. Alternatively, the stabilizing means can include an ice-containing vessel, and the establishing means then comprises means for conveying the stream along the aforementioned path a portion of which extends through the vessel. Such stabilizing means can perform a desirable sterilizing function upon the mass of air which flows through the vessel.

If the stabilizing means comprises one or more heat exchangers, each heat exchanger can comprise one or more tubular components (e.g., coils) consisting of or containing copper and being contacted by air which forms or which is to form the stream. Each heat exchanger can comprise an array of tubular components and means for conveying a heat exchange medium through the tubular components. The tubular components are installed in a predetermined portion of the aforementioned path so that they are contacted by air prior or subsequent to conversion into clean-room air. The array can include a grating of tubular components, and such array can be installed in immediate or close proximity of the outlet of a suitable distributor which forms part of the establishing means and directs clean-room air between the selected area and the surrounding atmosphere.

The apparatus preferably further comprises means for diverting at least a portion of the stream in a predetermined direction, e.g., to ensure that the stream flows in close or immediate proximity of a selected part of the body of a patient on the operating table. Such diverting means preferably comprises means for directing at least on secondary stream of air (preferably clean-room air) against the stream of clean-room air. The diverting means can be formed with an outlet which is adjacent to the outlet for the stream of clean-room air, and the configurations and positions of the two outlets can be selected in such a way that the secondary stream or streams at least partially surrounded the stream of clean-room air. The diverting means can comprise means (e.g., a portion of the operating table) for directing several secondary streams against the stream of clean-room air in the region of the selected area. Means can be provided for adjusting the rate and/or the direction of flow of air forming the secondary stream or streams, and such adjusting means can comprise one or more valves, flaps, slats or the like. The diverting means can comprise at least one nozzle and the adjusting means then comprises means for changing the orientation of the nozzle and/or the rate of flow of air from the nozzle.

The diverting means can comprise means for generating at least one secondary stream of air and means for maintaining the temperature of the secondary stream at a predetermined value which approximates the temperature of the stream of clean-room air, which exceeds the temperature of the stream of clean-room air or which is below the temperature of the stream of clean-room air.

The establishing means can comprise a generator of clean-room air, a distributor of clean-room air and conduit means for conveying clean-room air from the generator to the distributor. The latter has outlet means through which the stream of clean-room air issues to flow between the selected area and air in the surrounding atmosphere. Means is preferably provided for adjusting the position of the distributor relative to the selected area; such adjusting means can comprise means for moving the distributor relative to the operating talbe.

The distributor can comprise a substantially U-shaped member with two downwardly extending legs which flank the selected area and a web or bridge which connects the upper end portions of the legs to each other. The operating table is adjacent to the lower end portions of the legs and defines with the U-shaped member a passage for a part of the body of a patient on the table. The outlet means can be provided in part in the legs and in part in the web of the U-shaped member. Such outlet means can comprise a plurality of discrete openings, and the distributor can further comprise means for adjusting the rate and/or the direction of flow of air through at least some of the openings. That portion of the distributor which defines the outlet means preferably consists of a sintered material. Such material is preferably adjacent to the front side of the distributor, namely the side which faces the selected area.

The establishing means comprises one or more filters or other suitable means for sterilizing atmospheric air (i.e., for converting atmospheric air into clean-room air), and such sterilizing means can be installed upstream or downstream of the stabilizing means, i.e., the latter can influence sterilized or unsterilized air. The clean-room generator preferably comprises a housing, a motor-driven impeller or other suitable means for conveying air through the housing, and one or more sterilizing filters through which the air passes in the interior of the housing. The stabilizing means can be installed in the housing of the clean-room air generator, either downstream or upstream of the filter or filters, as considered in the direction of air flow through the housing. The filter or filters and the stabilizing means can be located upstream or downstream of the conveying means. The lower portion of the housing of the generator is preferably provided with floor-contacting wheels, and the inlet means for admission of atmospheric air into the housing is preferably located at a level well above the floor. The conveying means is preferably designed to draw air by way of the inlet means and to force such air to flow through the filter or filters. Disengageable coupling means can be provided to separably connect the aforementioned conduit means to the generator and/or to the distributor. Such coupling means preferably includes means for automatically sealing the conduit means and/or the outlet of the generator and/or the inlet of the distributor from the surrounding atmosphere in response to disengagement of the coupling means.

In accordance with one presently preferred embodiment of the invention, the stabilizing means comprises means for maintaining two or more different portions of the stream of clean-room air at different temperatures. For example, one portion of the stream can be heated and another portion of the stream can be cooled so that the temperature of air in the surrounding atmosphere is between the temperatures of the two portions of the stream. Alternatively, one portion of the stream can be cooled or heated more intensively than the other portion so that the temperatures of both portions of the stream are above or below the temperature of air in the surrounding atmosphere.

The distributor, the conduit means, the filter or filters, the outlet of the housing of the clean-room air generator, the coupling or couplings and/or certain other parts of the improved apparatus are preferably designed in such a way that they can be sterilized in an autoclave. The filter or filters are replaceably installed in the housing of the clean-room air generator, in the conduit means and/or in the distributor.

The apparatus preferably further comprises means for changing (especially increasing) the moisture content of the stream of clean-room air. A portion of the moisture changing means (e.g., a steam chamber) can be installed in the conduit means between the generator housing and the distributor. Alternatively, a portion of or the entire moisture changing means can be installed in the housing of the clean-room air generator, in the conduit means immediately upstream of the distributor or directly in the distributor. The moisture changing means can operate with steam or with water. Furthermore, the stream of clean-room air can be caused to pass through a solvent-containing sterilizing bath, i.e., the stream of clean-room air can be disinfected during passage through the moisture changing means. The latter can further comprise means for establishing an aerosol atmosphere.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
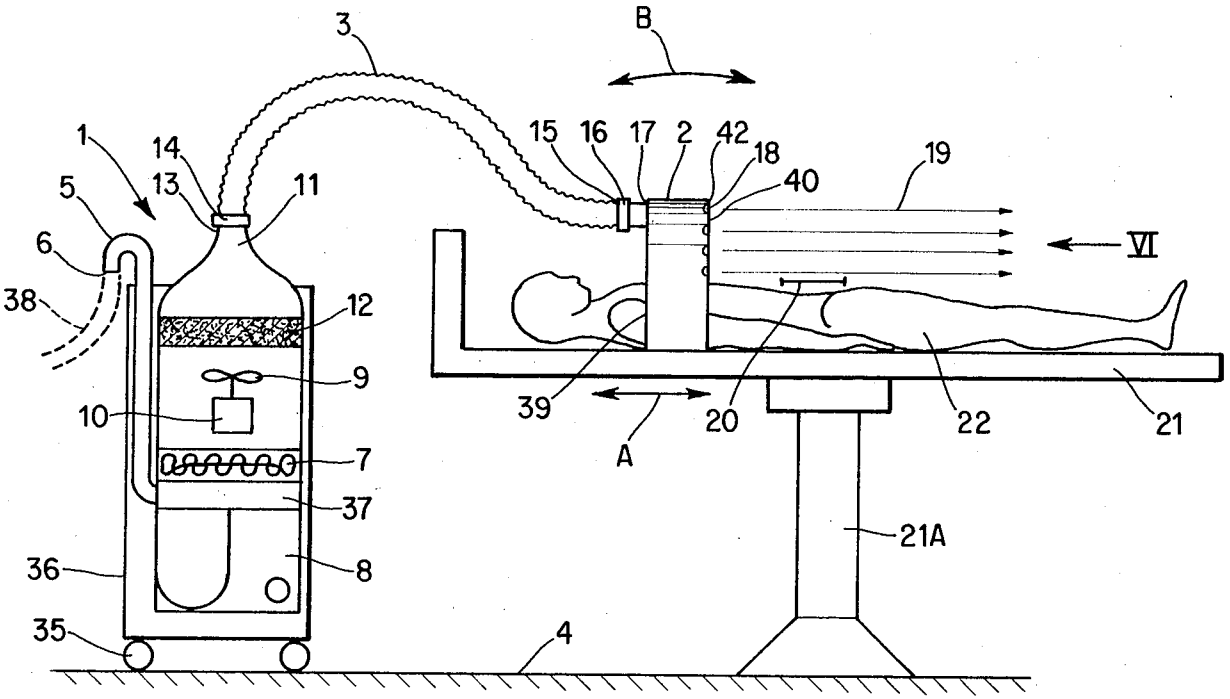
FIG. 1 is a schematic partly elevational and partly longitudinal vertical sectional view of an apparatus which embodies one form of the invention and wherein the means for thermally stabilizing the stream of clean-room air is installed in the housing of the generator of clean-room air.

Referring first to FIG. 1, there is shown an apparatus for insulating a selected area (occupied by a patient 22 resting on an operating table 21) from the surrounding atmosphere. More particularly, the improved apparatus is designed to prevent infection from developing in any selected part (such as 20) of or in the entire body of the person or animal occupying the operating table 21.

The improved apparatus includes a first unit which constitutes a means for establishing and maintaining a stream 19 of clean-room air between the selected area (occupied by a part of or the entire body of the patient 22) and air in the surrounding atmosphere, and a second unit which constitutes or includes a means for thermally stabilizing the stream 19, at least that portion of the stream which insulates the selected area from the surrounding atmosphere.

The first unit comprises a clean-room air stream generator 1 and a distributor head 2 which serves to direct the stream of clean-room air along that portion of the path for the stream which extends between the selected area (occupied by the patient 22) and the surrounding atmosphere. The means for connecting the generator 1 with the distributor head 2 (and for thus defining a portion of the aforementioned path) includes a flexible conduit in the form of a hose 3. The head 2 is located at a level above the operating table 21 and is preferably adjustable with reference thereto so that it can be shifted to any one of a practically infinite number of different positions with reference to the selected part 20 of the body of the patient 22. The selected part can constitute the abdominal region, the head, the neck, the hips, the knees or any other selected part of the anatomy. For example, the head 2 can be mounted for reciprocatory movement longitudinally of the operating table 21 as indicated by the double-headed arrow A. In addition to or in lieu of such shiftability, the head 2 can be pivoted in drrections which are indicated by the double-headed arrow B. Still further, the head 2 can be moved at right angles to the plane of FIG. 1 (in addition to or in lieu of the aforedescribed movements). All that counts is to ensure that the head 2 can be moved to any of a number of different positions in which the stream 19 of clean-room air is directed along that portion of the path which extends between the selected part of the body of the patient 22 and the surrounding atmosphere. It is further possible to provide a discrete support (e.g., a pedestal whose height can be varied and which is preferably mounted on wheels) which carries the distributor head 2 and may but need not be mounted on the operating table 21. Such support can be wheeled along the floor 4 to a selected position in order to ensure that the outlet 19 of the head 2 can direct the stream 19 in a desired direction and at a desired distance from the selected part of the body on the table 21. For example, the support for the head 2 can be moved to a position in which the stream 19 flows substantially or exactly tangentially of a convex or otherwise rounded part of the body 22. Tangential flow of the stream 19 has been found to be particularly effective in preventing contamination of the selected part (20) of the body 22 on the table 21 by the surrounding atmosphere. Substantially tangential flow of the stream 19 relative to the selected part of the body 22 exhibits the additional advantage that the flowing mass of clean-room air is not likely, or is less likely, to withdraw moisture from the selected part of the body. This is highly important in numerous instances, e.g., when the selected portion of the patient's body has been exposed to excessive heat as a result of a fire or an explosion.

It is desirable to place the generator 1 close or very close to the operating table 21 so as to reduce the need for an elongated hose 3. The utilization of a relatively short hose 3 simplifies its sterilization preparatory to the actual use of the improved apparatus. Such sterilization can be carried out in a conventional autoclave, not shown. Of course, the hose 3 should be sufficiently long to ensure that the head 2 can be moved to any selected position, with reference to the table 21, which is necessary for an optimum flow of the stream 19 along the selected part of or the entire body of the patient 22. The length of the hose 3 can be reduced on the additional ground that the illustrated generator 1 comprises a housing 36 which is mounted on rollers or wheels 35 so that the entire generator can also be shifted relative to the operating table 21 and distributor head 2. The manner in which the table 21 can be moved to different levels above the floor 4, and the manner in which the table can be turned about the axis of the pedestal 21A are conventional and, therefore, the corresponding instrumentalities are not specifically shown in FIG. 1.

The housing 36 confines a conveyor including a bladed rotary rotor or impeller 9 and a motor 10 therefor. The conveyor 9-10 serves as a means for conveying a stream of atmospheric air along a predetermined path wherein the stream of atmospheric air is converted into clean-room air and wherein the stream 19 of clean-room air thereupon flows between the patient 22 and the surrounding atmosphere. The motor 10 can be mounted on one or more resilient blocks or leaf springs so that it has at least some freedom of movement relative to the housing 36.

The generator 1 comprises or supports the means for thermally stabilizing the stream 19 before the latter comes into contact with the body of the patient 22 on the operating table 21. The stabilizing means includes means for influencing the temperature of air, either prior or subsequent to conversion into clean-room air, so as to ensure that the temperature of the stream 19 will deviate from the temperature of the surrounding atmosphere. This has been found to be highly desirable and advantageous in order to reduce the quantity of clean-room air which is needed for adequate sterilization of the area which is occupied by the patient 22 as well as to reduce the likelihood of contamination of such area by the contents of the surrounding atmosphere. The stabilizing means comprises a heat exchanger 7 which is mounted in the housing 36 at a level below the motor 10 and above a manifold 37 which latter receives atmospheric air by way of a conduit 6 whose inlet is located at a level well above the floor 4 (in the embodiment of FIG. 1, the intake end or inlet of the conduit 6 is located at the level of the upper end 5 of the housing 36) so as to greatly reduce the likelihood of drawing contaminated air from the region close to the floor. The purpose of the manifold 37 is to uniformly distribute the inflowing atmospheric air (the air is drawn by the impeller 9) across the entire heat exchanger 7 so as to ensure that the latter can uniformly influence each and every portion of the inflowing stream of atmospheric air. The heat exchanger 7 can be designed to lower the temperature of the inflowing atmospheric air so that the temperature of the stream 19 is below that of air in the surrounding atmosphere. In such apparatus, the heat exchanger 7 comprises one or more tubular components whose interior confines a stream of gaseous or liquid coolant and whose external surface is contacted by inflowing atmospheric air which is to be converted into the stream 19.

The apparatus of FIG. 1 can be equipped with an auxiliary hose 38 which can be used as an extension of the conduit 6 in order to draw atmospheric air from a location at a greater distance from the housing 36, for example, from the atmosphere outside of the room which accommodates the table 21 and the generator 1.

The impeller 9 forces the atmospheric air, which has been conditioned as a result of contact with the heat exchanger 7, to flow toward and into the hose 3. The inlet or intake end 13 of the hose 3 is separably connected with the outlet 11 of the housing 36 by a quick-release coupling 14 of any suitable design, e.g., a coupling employing a bayonet mount.

The means for sterilizing the stream of atmospheric air, i.e., for converting such stream into the clean-room stream 19, comprises a filter 12 which is mounted in the housing 36 upstream of the outlet 11 and through which the entire stream of conditioned atmospheric air is compelled to flow on its way toward and into the inlet 13 of the hose 3. The filter 12 is designed to treat the stream of atmospheric air in several ways, such as by removing microorganisms to thus sterilize the air as well as by removing any particles of dust and/or other foreign matter which should not reach the selected area above the operating table 21. The illustrated filter 12 constitutes but one of numerous means which can be used for sterilizing and otherwise treating the stream of atmospheric air so as to convert it into the stream 19 which is ready to come in contact with the selected part (20) of the patient's body. For example, the stream of air which has been conditioned by the heat exchanger 7 can be caused to flow through a body of sterilizing liquid.

The discharge end 15 of the hose 3 is connected with the inlet 17 of the distributor head 2 by means of a second quick-release coupling 16 which may but need not be identical with the coupling 14. The inlet 17 extends from that (rear) side 39 of the distributor head 2 which faces away from the selected part 20 of the body of the patient 22 on the table 21. The rear side 39 of the illustrated head 2 is flat and is parallel or substantially parallel to a flat front side 40 which faces away from the inlet 17. However, it is equally within the purview of the invention to provide the inlet 17 at another location in or on the head 2. Actually, the inlet 17 can be provided at any desired location as long as it can supply the outlet 18 with a quantity of clean-room air which suffices to form the steam 19 and which can be distributed in a manner such as to be most likely to accomplish the objects of the invention, namely to insulate the area which is occupied by the patient 22 from the surrounding atmosphere in a highly efficient, reliable and economical manner.

Figure 6:
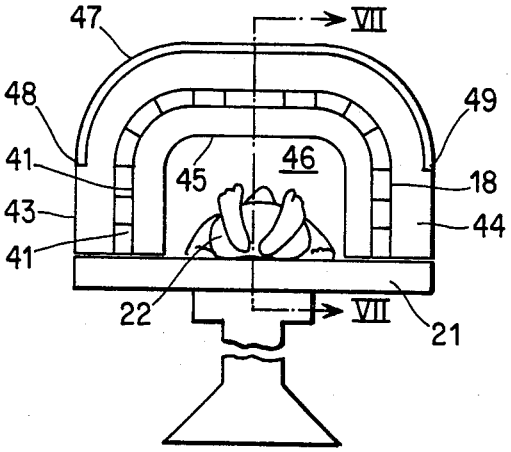
FIG. 6 is an enlarged front elevational view of the distributor and of a shroud as seen in the direction of arrow VI in FIG. 1.

As shown in FIG. 6, the outlet 18 can have a substantially arcuate shape, such as the shape of the inverted letter U. It is presently preferred to form the front side 40 of the distributor 2 with a composite outlet 18 which consists of a number of smaller openings or orifices 41 each of which may but need not have a polygonal outline. The reference character 42 denotes in FIG. 1 a means for adjusting the effective cross-sectional area of the outlet 18. Such adjusting means can constitute an adjustable throttle or another type of flow restrictor means for the stream 19. The adjusting means 42 can be actuated by an authorized person to change the quantity of clean-room air which leaves the distributor head 2 per unit of time and/or to change the direction of flow of the stream. For example, the head 2 can confine or carry adjusting means 42 which includes pivotable or reciprocable flaps (e.g., one for each of the openings or orifices 41 and means for jointly moving all of the flaps to the same or to a different extent), blinds with pivotable and/or otherwise movable slats, a discrete diaphragm for each of the openings or orifices 41, or the like. The arrangement may be such that the adjusting means 42 is actuatable to vary the rate of outflow of clean-room air between zero and a predetermined maximum rate. Flaps, slats or like components of the adjusting means 42 can simultaneously serve as a means for changing the direction of flow of air which is to form the stream 19. The adjusting means 42 can include (a) one or more flow restrictors which can be operated to regulate the rate of flow of clean-room air from the head 2, and (b) one or more flaps, slats or like parts which can be operated to select the direction of flow of air along that portion of the path for clean-room air which extends between the body of the patient 22 and the surrounding atmosphere.

Figure 7:
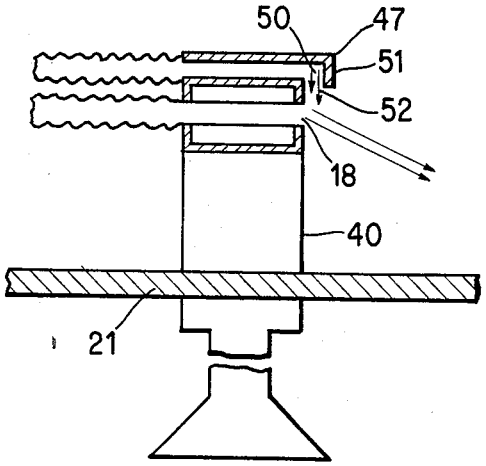
FIG. 7 is a sectional view as seen in the direction of arrows from the line VII—VII of FIG. 6.

As shown in FIGS. 6 and 7, the distributor head 2 can constitute or resemble an inverted U-shaped member having inner and outer portions which flank the composite outlet 18. The two upright legs 43, 44 of the head 2 which is shown in FIGS. 6 and 7 extend toward and can be movably mounted on the operating table 21. The upper end portions of the legs 43, 44 are connected to each other by an arcuate web or yoke 45 which extends transversely of the table 21. The dimensions of the legs 43, 44 and web 45 are preferably selected in such a way that these portions of the head 2 define a passage 46 which is large enough to permit the body of the patient 22 to move therethrough (this can be readily seen in FIG. 6). Thus, the head 2 can be moved longitudinally of the body of the patient 22 on the table 21 and/or vice versa so as to move the outlet 18 close to a selected part of the body.

At least that portion of the distributor head 2 which includes the front side 40 can be made of a sintered metallic, ceramic or other suitable material, preferably a sintered metal which exhibits satisfactory sterilizing properties. As shown in FIGS. 6 and 7, the head 2 can further include or it can be associated with a stationary or adjustable shroud or baffle 47 which constitutes a form of roof above the web 45 and serves to direct a second or secondary stream 52 of clean-room air at a selected angle (in FIG. 7, the angle is 90 degrees) to the direction of flow of the stream 19 downstream of the outlet 18. The shroud 47 extends forwardly beyond the front side 40 of the deflector head 2 and has a downwardly extending front marginal portion 51 which changes the direction of flow of the secondary stream from horizontal to vertical, i.e., from a direction which is parallel to the direction of flow of the primary stream 19 to a direction which is transverse to that of the flow of stream 19. The end portions 48 and 49 of the shroud 47 (as considered transversely of the operating table 21) are curved and extend along the outer sides of the upper portions of the respective legs 43 and 44. The reference character 50 denotes in FIG. 7 the path for the flow of the secondary stream 52 toward and against the stream 19 downstream of the outlet 18. The downstream end of the path 50 is adjacent to the front side 40 of the head 2. The left-hand side of the marginal portion 51 of the shroud 47 (as viewed in FIG. 7) is or can be parallel to the adjacent portion of the front side 40. The shroud 47 can be mounted for pivotal, reciprocatory and/or other movement relative to the parts 43, 44 and 45 of the head 2 in order to enable an authorized person to change the rate and/or the direction of flow of the secondary stream 52. For example, the adjustability of the shroud 47 can be such that the secondary stream 52 can be caused to flow downwardly at right angles to the direction of flow of the primary stream 19 or that the two streams make an oblique angle. In other words, the secondary stream 52 can flow at right angles or at an oblique or obtuse angle to the plane of the upper side of the operating table 21.

The stream 19 issuing from the outlet 18 of the head 2 which is shown in FIGS. 1, 6 and 7 has a substantially inverted U-shaped cross-sectional outline and can flow longitudinally of the entire body of the patient 22 or longitudinally of a selected part of the body, depending on the location of the part to be treated (e.g., by incision) and on the need for access to such part during treatment.

The secondary stream 52 can be diverted from the mass of clean-room air in the interior of the distributor head 2 so that the space between the upper side of the web 45 and the underside of the shroud 47 need not be connected to a discrete source of clean-room air. However, it is possible to employ a discrete generator for treatment of atmospheric air which is to be converted into clean-room air for admission into the path 50.

Figure 5:
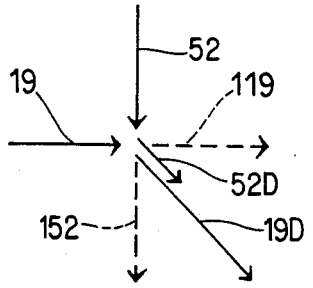
FIG. 5 is a vector diagram showing the directions of various streams of clean-room air in the apparatus of the present invention.

FIG. 5 shows the undeflected primary stream 19, the undeflected secondary stream 52, the path (119) of the primary strea 19 in the absence of deflection, the path (152) of the secondary stream 52 in the absence of deflecting engagement with the primary stream 19, the path 19D of the deflected or diverted primary stream 19, and the path 52D of the deflected secondary stream 52. The inclination of the path 19D relative to the path 119 can be altered by changing the rate of flow of air which forms the stream 19 and/or 52, and/or by changing the inclination of the undeflected secondary stream 52.

Figure 2:
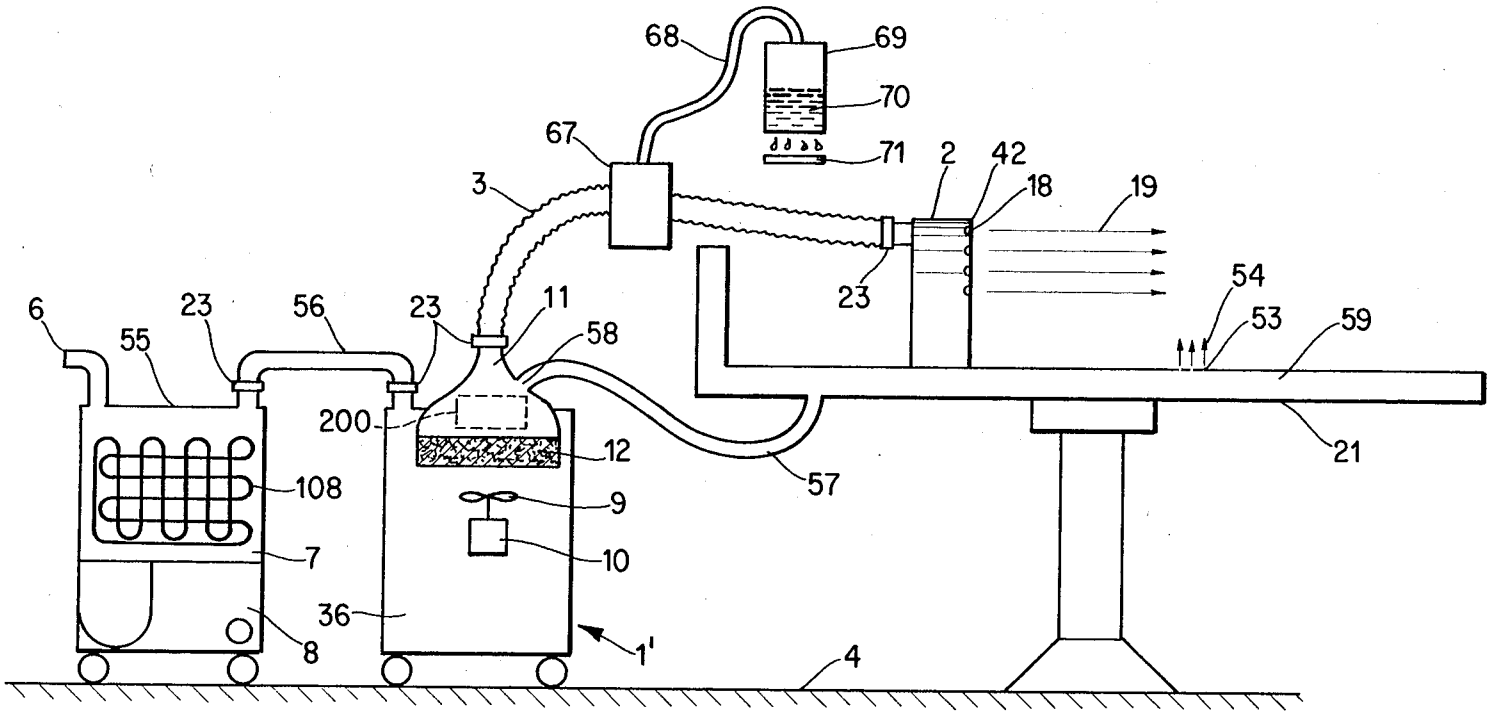
FIG. 2 is a similar partly elevational and partly sectional view of a second apparatus wherein the means for thermally stabilizing the stream of clean-room air constitutes a separate module.

FIG. 2 shows that the operating table 21 can be provided with one or more rows of air-discharging openings 53 which enable secondary streams 54 to flow at an angle to the direction of flow of the primary stream 19. FIG. 2 further shows a conduit 57 which is connected with an apertured portion 58 of the outlet 11 of the housing 36 and serves to admit clean-room air from the path portion downstream of the filter 12 of the generator 1' into the suitably configurated channels 59 in the table 21 so that the diverted air can form the secondary streams 54. These streams can be used to divert or deflect selected portions of the primary stream 19 in a direction upwardly and away from the upper side of the table 21. For example, the table 21 can be formed with two rows of openings 53, one row at each side of the body of the patient on the table.

Thermal stabilization or conditioning serves to bundle or confine the stream 19. Such stabilization or conditioning involves maintaining the stream 19 at a temperature above or below that of the surrouding atmosphere. This can be achieved by using the heat exchanger 7 which admits heat to or which withdraws heat from the stream of atmospheric air that flows into and beyond the conduit 6 and manifold 37 under the action of the impeller 9 and is thereupon forced to pass through the filter 12. The heat exchanger 7 is preferably convertible or exchangeable in order to ensure that the temperature of the stream 19 can be above or below that of the surrounding atmosphere and that the temperature of the stream 19 can be changed if the temperature of air around the stream 19 changes. The selected temperature of the stream 19 will also depend on the circumstances under which the apparatus is used, i.e., on the nature and duration of treatment of the body on the table 21, the nature of injury or illness which is to be treated and/or the comfort of the physician and/or her or his assistants.

If the heat exchanger 7 is to cool the stream of air which is conveyed by the impeller 9, that part of the heat exchanger which is located downstream of the manifold 37 constitutes or can constitute a component part of a refrigerating system 8 which is installed in the lowermost part of the housing 36 of the generator and comprises a compressor, a condenser and a supply of refrigerant which expands in response to exchange of heat with atmospheric air downstream of the manifold 37. The heat exchanger 7 then comprises one or more tubular components whose external surfaces are in contact with the stream of atmospheric air and which confines the refrigerant. The refrigerating system 8 further comprises means for circulating the refrigerant along an endless path a portion of which is defined by the heat exchanger 7. The circulating refrigerant withdraws heat from the air stream and reduces the temperature of air which is to form the stream 19. As a rule, it suffices to reduce the temperature of inflowing atmospheric air by a few degrees centigrade e.g., by 2–3 degrees. It is desirable to select the temperature of the stream 19 in such a way that it appreciably deviates from the temperature of air in the surrounding atmosphere, i.e., to ensure a certain bundling or confinement of the stream 19 as a result of the differential between its temperature and the temperature of the air around it. In other words, the cooling action of the refrigerating system 8 must be selected with a view to compensate for eventual heating of sterilized air in the space for the impeller 9, in the hose 3 and in the head 2 before the sterilized air can issue via outlet 18 to form the stream 19. If the motor 10 is installed in the housing 36 so that it is contacted by air flowing toward the filter 12 (such mounting of the motor 10 is shown in each of FIGS. 1 to 4), the cooling action of the refrigerating system 8 must be sufficiently pronounced to ensure that the temperature of the stream 19 deviates from that of the surrounding atmospheric air by the selected number of degrees centigrade in spite of the fact that the housing of the motor 10 exchanges heat with the inflowing air. The filter 12 is also likely to exchange some heat with air that flows therethrough, and such exchange of heat must also be considered in selecting the cooling action of the refrigerating system 8.

The entire distributor head 2, the entire hose 3, the entire filter 12 and the entire outlet 11 of the housing 36 are preferably sterilizable in an autoclave or in discrete (different) autoclaves. Furthermore, the filter 12 is removably and exchangeably installed in the housing 36 so that it can be replaced with a spare filter or with a different filter during treatment in an autoclave.

Highly accurate selection of the temperature of air which is to form the stream 19 can be ensured if the refrigerating system 8 including or cooperating with the heat exchanger 7 constitutes a component part of a separate module 55 as shown in FIG. 2. The conduit 6 is provided on or is connected with the module 55, and the outlet of the module 55 is separably coupled with an intermediate conduit 56 by a first quick-release coupling 23 which may be identical with the coupling 14 and/or 16. A similar coupling 23 connects the discharge end of the intermediate conduit 56 with the inlet of the housing 36 for the air conveying means 9, 10 and the filter 12. The impeller 9 can constitute the means for drawing atmospheric air into the module 55 via conduit 6 and for causing the thus admitted air to flow through the housing 36 and hose 3 as well as the aforementioned conduit 57 leading to the channel or channels 59 in the operating table 21. The means 53 for establishing one or more secondary streams of clean-room air can be used in addition to or in lieu of the aforediscussed means (including the shroud 47) for establishing a secondary stream 52 at a level above the major part of the outlet 18. The openings 53 can also contain suitable flow restrictors and/or flaps or the like to change the rate and/or the direction of flow of secondary streams 54. The panel of the operating table 21 which is shown in FIG. 2 is provided with the aforementioned channel or channels 59 for the flow of sterilized air from the conduit 57 to the openings 53. If desired, one row of openings 53 can be sealed while the other row or rows of openings 53 permit secondary streams 54 to pass therethrough, or vice versa.

Figure 3:
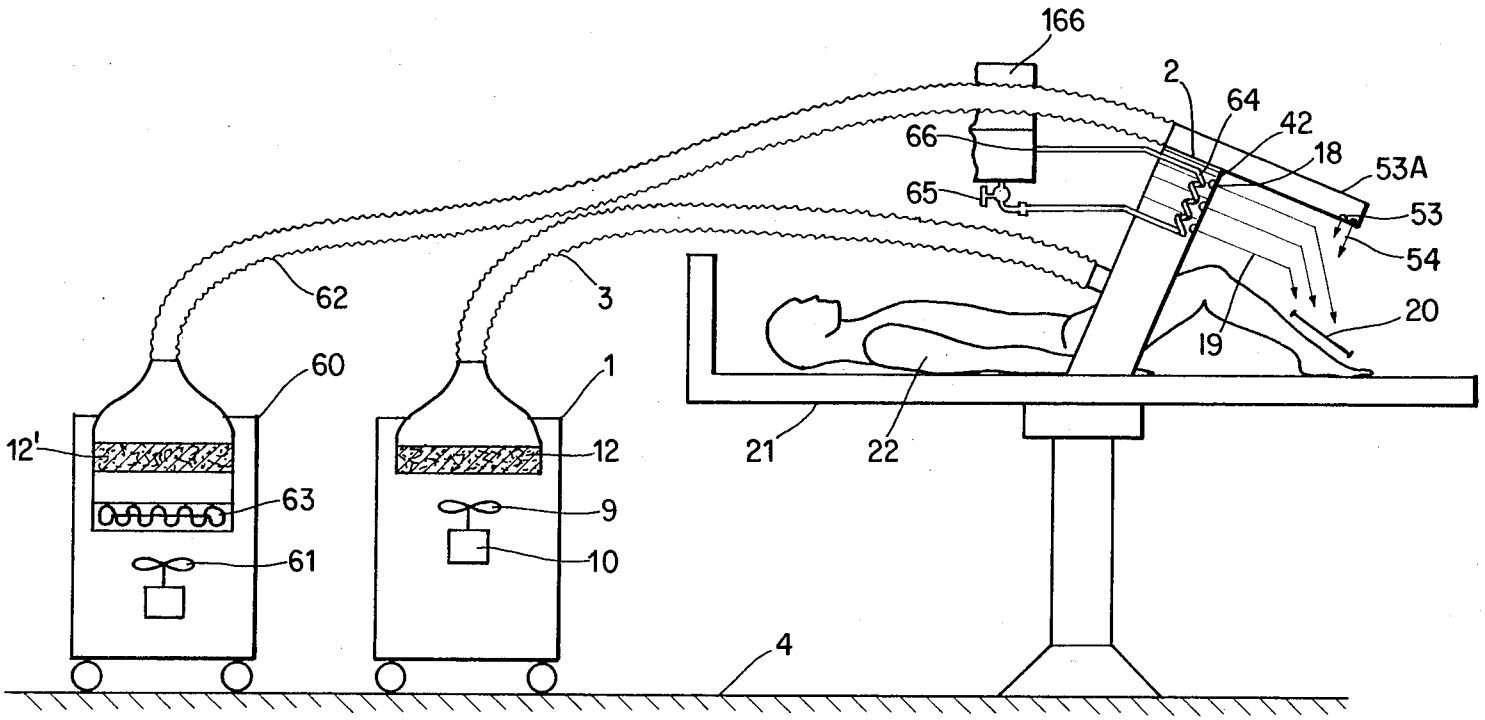
FIG. 3 is a similar partly elevational and partly sectional view of a third apparatus with two generators of clean-room air, one for the formation of a primary stream and the other for the formation of a secondary stream.

FIG. 3 shows that the secondary stream or streams of clean-room air can be generated by a discrete generator 60 which contains a conveyor 61 serving to draw atmospheric air into the housing of the generator 60, means 63 (e.g., a heat exchanger) for thermally stabilizing the inflowing air, and a filter 12' or analogous means for sterilizing the mass of thermally stabilized air which is to form the secondary stream or streams. A conduit 62 (e.g., a flexible hose) is provided to connect the outlet of the second generator 60 with the corresponding inlet of the head 2, i.e., with the means for establishing a secondary stream 54 which issues from one or more orifices 53 of a preferably adjustably mounted nozzle 53A on the head 2. The heat exchanger 63 can be used to heat or cool the stream of air which flows toward and into the conduit 62. This renders it possible to maintain the temperature of the secondary stream 54 at, above or below the temperature of the primary stream 19. The properly conditioned secondary stream 54 confines or bundles the primary stream 19 and even further reduces the likelihood of contamination of the primary stream 19 by air in the surrounding atmosphere. The provision of the filter 12' in the second generator 60 is optional but desirable and advantageous. Thus, the secondary stream 54 can perform a highly desirable deflecting or diverting function without any or without pronounced sterilization of air in the generator 60. However, the utilization of sterilized air as the medium of the secondary stream 54 even further enhances the insulating action of the primary stream 19 and thus even further reduces the likelihood of contamination of the area which is occupied by the body of the patient on the table 21.

FIG. 3 further shows that the means for stabilizing the temperature of the primary stream 19 can be modified (and more specifically simplified), not only as regards its positioning relative to the sterilizing means (filter 12) but also as concerns the number of complexity of its constituents. The stabilizing means for the stream 19 comprises a tubular component 64 (e.g., a length of coiled copper pipe) which is installed in the distributor head 2 upstream of the outlet 18 and confines a stream of liquid, preferably water, which is admitted from a source 66 via adjustable valve means 65 and is returned to the source 66 or is conveyed into a drain (not shown) so that the liquid medium exchanges heat with sterilized air, i.e., the means for thermally stabilizing the stream 19 is located downstream of the sterilizing means. The heat exchanger 63 in the second generator 60 can be omitted if the coil 64 in the distributor head 2 is dimensioned and mounted in such a way that the stream of liquid flowing through the coil 64 can also exchange heat with sterilized air flowing from the conduit 62 toward the orifice or orifices 53.

The reference character 166 denotes a plant which recovers heat from water issuing from the coil 64. The thus cooled water can be returned into the coil 64 via valve 65. The illustrated coil 64 can be replaced by a system of tubular components, e.g., by a grating resembling that shown at 108 in FIG. 2) which defines one or more openings for the passage of air which is to form the stream 19 and/or 54. The grating can be provided with a large number of relatively small openings to ensure highly predictable exchange of heat between the stream 19 and/or 54 on the one hand and the liquid which is circulated through the grating on the other hand.

Figure 4:
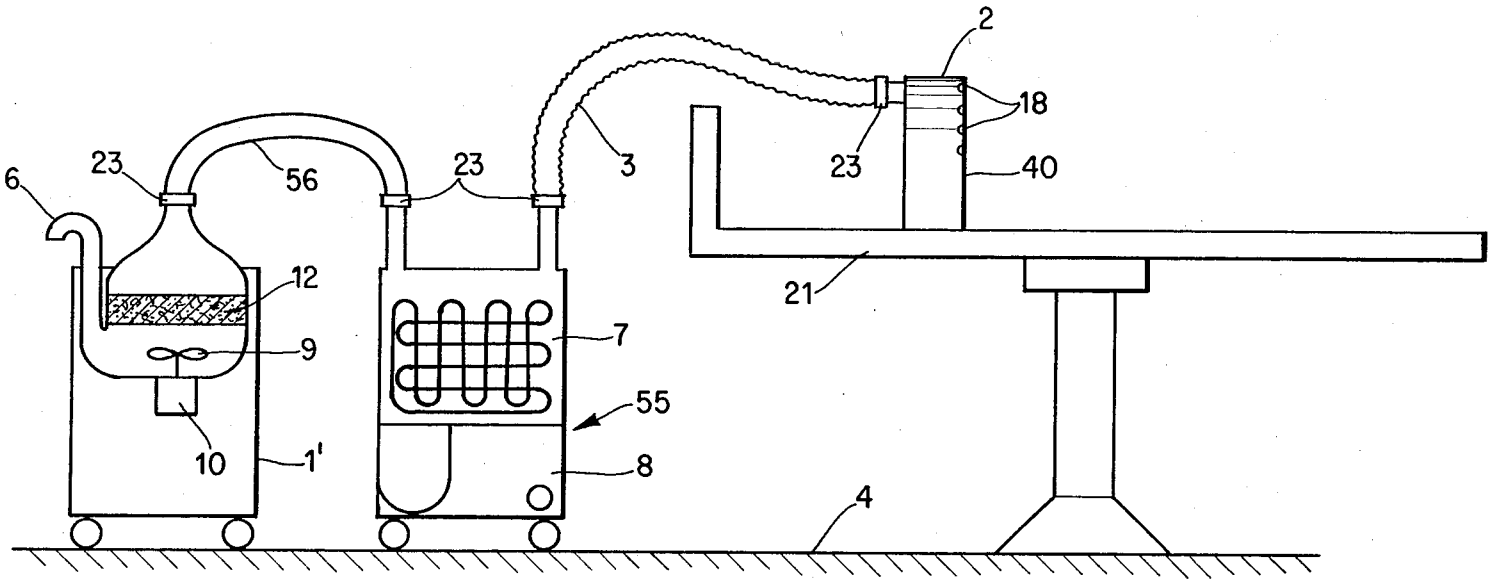
FIG. 4 is a similar partly elevational and partly sectional view of a fourth apparatus which constitutes a modification of the apparatus of FIG. 2.

The apparatus of FIG. 4 constitutes a modification of the apparatus which is shown in FIG. 2. The module 55 is disposed downstream of the generator 1' so that the inflowing atmospheric air is sterilized (at 12 in the generator 1') prior to thermal stabilization in the module 55. The thus sterilized and stabilized mass of air is admitted into the hose 3 to flow into the distributor head 2 and to issue via outlet 18 in the form of a stream of clean-room air. The conduit 56 between the generator 1' and the module 55 of FIG. 4 is separably connected with such units by quick-release couplings 23, the same as in the embodiment of FIG. 2. Similar quick-release couplings 23 (replacing the couplings 14 and 16 of FIG. 1) can be provided between the outlet of the hose 3 and the head 2 as well as between the inlet of the hose 3 and the outlet of the module 55.

Figure 8:
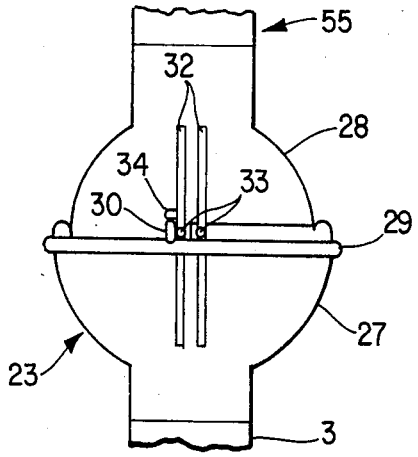
FIG. 8 is an enlarged elevational view of an assembled quick-release coupling which can be utilized in the apparatus of the present invention.
Figure 9:
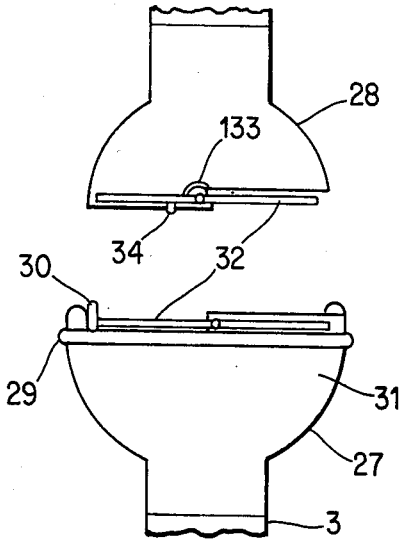
FIG. 9 shows the coupling of FIG. 8 in disengaged condition.

One presently preferred form of quick-release couplings 23 is shown in FIGS. 8 and 9. The couplings 23 of FIGS. 8 and 9 is assumed to be used as a means for separably connecting one end portion of the hose 3 with the outlet of the module 55 which is shown in FIG. 4. It is designed in such a way that it prevents penetration of microorganisms into the interior of the module 55 and/or hose 3 when its two sections are separated from each other, e.g., in order to move the module 55 (which is mounted on wheels) into storage or to facilitate inspection and/or repair of this module at a location which is remote from the operating room. The coupling 23 is a modified version of a bayonet mount and includes a first hollow section 27 which is mounted on the hose 3 and a second hollow section 28 on the outlet of the module 55. The section 27 carries or includes a ring 29 which is rotatably relative to the hose 3 and is provided with an axially parallel motion transmitting element 30 in the form of a pin or post. The element 30 sealingly extends into the internal space 31 of the section 28 when the sections 27 and 28 are connected to each other. The sections 27 and 28 carry turnable sealing members 32 which can be moved between open and closed (sealing) positions in response to rotation of the ring 29, and more particularly in response to rotation of the ring 29 with reference to the remaining portion of the section 27 and relative to the section 28. The sections 27, 28 can be separated from each other only when the respective members 32 seal the internal spaces of such sections from the surrounding atmosphere. The fulcra for the sealing members 32 are shown at 33; such fulcra define pivot axes which are normal to the direction of flow of air through the assembled coupling 23, i.e., the axes of the fulcra 33 are normal to the plane of FIGS. 8 and 9. Torsion springs 133 (only one shown) are provided to bias the members 32 to their closed or sealing positions.

The sealing member 32 in the section 28 has a projection 34 which is engaged by the motion transmitting element 30 when the coupling 23 is assembled, i.e., when the stream of sterilized or unsterilized air is free to flow from the module 55 into the hose 3. In order to disengage the coupling 23, the operator rotates the ring 29 relative to the section 27 whereby the element 30 shares such movement of the ring 29 so that the corresponding torsion spring 133 is free to move the sealing member 32 in the section 28 to open position at the rate at which the ring 29 is rotated toward that end position in which the sections 27, 28 can be separated from each other. The pivoting sealing member 32 in the section 28 pivots the sealing member 32 in the section 27 so that the latter sealing member assumes its sealing position under the action of the respective spring 133 as well as under the action of the sealing member 32 in the section 28. The two sealing members 32 are preferably provided with suitable O-rings, sealing lips or like elastic parts which ensure reliable sealing of the interior of the module 55 and the interior of the hose 3 from the surrounding atmosphere when the coupling 23 of FIGS. 8 and 9 is disengaged. Additional sealing elements in the form of elastic lips, O-rings or the like can be provided to prevent eventual accumulations of dust and/or other foreign matter from penetrating into the module 55 and/or hose 3 when the coupling 23 of FIGS. 8 and 9 is disengaged. It is preferred to place the two sealing members 32 close to each other when the coupling 23 is engaged (see FIG. 8).

The customary prongs and slots of the bayonet mount on the ring 29 and section 28 are not specifically shown in the drawing.

The filter 12 or 12' can be placed upstream or downstream of the conveyor means 9-10 or 61. For example, and referring again to FIG. 2, the motor 10 and the impeller 9 can be installed (at 200) in the outlet 11 of the housing 36 of the generator 1' so that the impeller draws sterilized air through the pores of the filter 12. As explained above, and as shown in FIGS. 2 and 4, the means for thermally stabilizing the primary stream or any other stream of clean-room air can be located ahead of or downstream of the sterilizing means.

It is further within the purview of the invention to provide a generator with means for supplying two or more streams of air at different temperatures. For example, the refrigerating system 8 and the heat exchanger 7 of FIG. 1 can be designed in such a way that they heat or cool the inflowing air to different temperatures. The housing 36 then comprises a corresponding number of outlets 11, and each outlet admits air into a discrete hose 3. The distributor head 2 then comprises two or more parts each of which is sealed from the other part and each of which receives air (at a given temperature) from the corresponding hose 3. The distributor head then further comprises two or more discrete outlets each of which discharges a discrete primary stream at a given temperature which deviates from the temperature(s) of the other stream or streams. The two or more streams which issue from the modified distributor head preferably flow along parallel or substantially parallel paths. The just discussed modification of the apparatus exhibits a number of advantages. For example, one of several streams issuing from the distributor head can be warmer or cooler than the other stream or streams and can be discharged in such direction that it heats or cools the hands of the physician performing a lengthy operation, i.e., the hands can be maintained at a temperature which is comfortable and enables the physician to carry out a lengthy treatment without stiffening of fingers.

When the improved apparatus is to be put to use, the motor 10 is started subsequent to selection of the temperature of refrigerant in the refrigerating system 8 or in the coil 64 so as to ensure that the temperature of sterilized air flowing into or beyond the hose 3 is maintained within a desired range (such temperature can be higher or lower than the temperature of air surrounding the area which is occupied by the body of the patient 22 on the table 21). The filter sterilizes the stabilized or unstabilized air stream so that the hose 3 receives a mass of clean-room air which is then converted into the stream 19 as a result of flow through and beyond the outlet 18 of the distributor head 2. As mentioned above, the head 2 can be moved relative to the table 21 so as to ensure that the stream 19 flows in a desired direction, preferably tangentially of the selected part 20 of the body of the patient on the operating table. The adjusting means 42 and/or the shroud 47 and/or the nozzle 53 can be manipulated to select the rate of flow of air which forms the stream 19 and/or to select the direction of flow of the entire stream or certain portions of the stream. As explained above, the secondary stream or streams (52, 54) can be diverted from the mass of air which is to form the primary stream 19, or such secondary stream or streams can be obtained from air which is drawn separately and is subjected to a separate stabilizing and sterilizing treatment.

Confinement or bundling of the stream 19 can be enhanced still further by changing its moisture content, if necessary, so that the moisture content is maintained at a preselected value. Moreover, admission of moisture into the stream 19 is often desirable and advantageous if it is necessary to ensure that the stream 19 cannot draw moisture from the selected part (20) of the body of a patient on the operating table 21. This is important when the patient is to be treated for burns and similar injuries. Moreover, admission of moisture into the stream 19 (or the maintenance of such moisture at an optimum value) is desirable and advantageous on the additional ground that, if the direction of flow of the stream 19 is not selected with a maximum degree of precision, a relatively dry stream 19 would be likely to withdraw moisture from a portion of or the entire wound, even if its moisture content is satisfactory (i.e., even if such stream would be unlikely to dry the wound or a portion of the wound were it caused to flow in an optimum direction).

FIG. 2 shows a moisturizing or moisture changing unit which includes a gas heater 71 serving to evaporate a body of liquid 70 in a vessel 69. The resulting steam is conveyed, via conduit 68, into a moisturizing device (steam chamber) 67 which is installed in the hose 3 and ensures that the stream of sterilized and conditioned air in the hose 3 comes into requisite contact with steam so that the moisture content of air entering the distributor head 2 matches or closely approximates the selected value. Steam which flows via conduit 68 is admitted into the hose 3 at a variable rate (the valve which regulates the rate of steam flow in the conduit 68 is not specifically shown) so as to ensure that the moisture content of the stream of air entering the distributor head 2 is sufficiently high for the particular treatment of a patient on the table 21. Steam is sterile so that its admission into the mass of sterilized air in the conduit 3 does not affect the ability of the stream 19 to properly insulate the body of the patient from air in the surrounding atmosphere.

The mass of steam which enters the chamber 67 is finely distributed in the stream of sterilized air so that the danger of condensation of steam on its way toward and immediately after it issues from the outlet 18 of the distributor head 2 is very remote or nil. It has been found that finely distributed steam flows with the stream 19 and prevents such air from withdrawing moisture from the selected part of the body of a patient on the table 21. In the absence of adequate moisturizing, the stream 19 could act not unlike a sink by drawing appreciable quantities of moisture from a wound, even if the flow of the stream 19 were substantially or exactly tangential to the selected part of the patient's body. The moisture content of the stream 19 can be increased quite substantially, especially when the patient is to be treated for burns.

The stream 19 exhibits the additional advantage that it withdraws germs from the selected part of the body of a patient on the operating table. This is attributable to the diluting effect of the stream 19. The diluting effect can be enhanced by properly selecting the rate as well as the direction of flow of the stream 19 past the wound or wounds.

The means for moisturizing the stream 19 can be modified in a number of ways without departing from the spirit of the invention. For example, the stream of air flowing in the hose 3 can be caused to pass through a body of liquid, especially through a bath of sterilized water. The moisturizing means can constitute or assist the means for stabilizing the temperature of the stream 19. For example, the stream can be caused to flow through a water bath which is maintained at a predetermined temperature so that the temperature of the stream which issues from the outlet of the distributor head 2 is above or below the temperature of air in the surrounding atmosphere. The moisturizing means can be used in conjunction with a temperature stabilizing means in the form of a mass of ice which is contacted by the mass of air that is to form the stream 19.

Still further, the moisturizing means 67–71 of FIG. 2 can be installed at a different location, e.g., in or immediately ahead of the head 2 or directly in the generator. If the moisturizing means is installed in the generator, it can be placed between the conveyor 9,10 and the outlet 11 of the housing 36 shown in FIG. 1.

The moisturizing means can further serve to enhance the sterilizing quality of the stream 19. For example, the moisturizing means can serve to contact the mass of air which is to form the stream 19 with a solvent for an antiseptic substance. The moisturizing device can also establish an aerosol atmosphere which is particularly suitable to ensure adequate sterilization of the affected or selected part of a patient's body.

An important advantage of the improved method and apparatus is that the thermally stabilized stream 19 establishes a pronounced and reliable barrier between the selected area and air in the surrounding atmosphere. It has been found that the stabilized stream 19 (whose temperature deviates from that of air in the atmosphere surrounding the selected area) can reliably prevent contamination of the selected area for any desired interval of time. The stream 19 and air in the surrounding area establish a clear boundary which remains pronounced as long as the stream 19 flows, i.e., even that layer or those layers of the stream 19 which are immediately adjacent to air in the surrounding atmosphere maintain their desirable characteristics. Moreover, the boundary between the stream 19 and air in the surrounding atmosphere remains pronounced not only in close or immediate proximity of the outlet 18 but also at a considerable distance from such outlet. The distance can equal or exceed the height of a grown person so that the stream 19 can readily shield the entire body of an adult on the operating table.

The provision of aforediscussed means for deflecting portions of or the entire stream 19 is desirable and advantageous because the stream 19 can be caused to flow very close to and in an optimum direction with reference to the selected area. The means for adjusting the direction of flow of the secondary stream or streams renders it possible to direct the stream 19 into a path which is very close to a selected part of the body on the table 21 but not sufficiently close to permit withdrawal of moisture from a wound. The regulation is very simple and reliable; for example, it is merely necessary to provide means for changing the rate and/or the direction of flow of one or more secondary streams. The adjusting means can be simple and can be operated by hand or by motors.

Heretofore known apparatus for generating and directing streams of clean-room air are designed to ensure adequate shielding or insulation of the selected area from air in the surrounding atmosphere by generating a very strong stream of clean-room air which is particularly strong if it is to insulate a selected area at a considerable distance from the outlet. This necessitates the utilization of large blowers, especially since the sterilizing step involves the use of filters which offer a pronounced resistance to the flow of air therethrough. The apparatus of the present invention can employ a relatively small impeller because the step of thermally stabilizing the stream 19 renders it possible to ensure reliable insulation of the selected area from air in the surrounding atmosphere with a relatively weak stream which is effective in the region close to as well as in regions at a considerable distance from the distributor. The density of the properly stabilized stream 19 is so pronounced that it constitutes an effective barrier against contamination of the selected area even if its thickness is minimal. Moreover, losses of clean-room air are surprisingly low because relatively small quantities of such air suffice for effective insulation of the selected area. This entails a reduction of energy requirements for operation of the motor or motors 10 and a reduction of noise.

The stabilizing step is relatively simple and inexpensive because the temperature of the stream 19 need not appreciably deviate from that of air in the surrounding atmosphere. As mentioned above, the temperature of the stream 19 can exceed the temperature of air in the surrounding atmosphere by a few degrees centigrade (or vice versa) so that the stream 19 need not be subjected to a pronounced heating or cooling action. This renders it possible to employ relatively simple, compact and inexpensive stabilizing or conditioning means. Heating or cooling of air which forms the stream 19 in close or immediate proximity of the outlet 18 of the distributor head 2 exhibits the advantage that the temperature of the stream can be maintained at or very close to an optimum value and that such temperature cannot be influenced by unpredictable or hard-to-monitor parameters, such as the rate of heat exchange with the motor for the impeller, the rate of heat exchange with the outlet of the generator housing, the rate of heat exchange with one or more conduits, and the amounts of heat which are supplied or withdrawn by the distributor head.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A method of insulating from the surrounding atmosphere a selected area which is occupied by a part of or the entire body of a patient on an operating table, comprising the steps of establishing a stream of clean-room air between the selected area and the surrounding atmosphere including causing the stream to flow along a predetermined path and in a predetermined direction substantially tangentially of the selected area; and bundling and confining the stream by thermal stabillization including maintaining the temperature of the stream below that of the surrounding atmosphere without appreciably influencing the temperature in the selected area.

2. The method of claim 1, further comprising the step of diverting a portion of said stream from said path in a second direction making a predetermined angle with said predetermined direction.

3. The method of claim 2, wherein said diverting step includes establishing a second stream of thermally syabilized clean-room air and directing said second stream against the stream in said path.

4. The method of claim 3, wherein said directing step includes conveying the second stream along a second path making a predetermined angle with the stream in said predetermined path.

5. The method of claim 3, wherein said directing step includes conveying the second stream substantially transversely of said path.

6. The method of claim 3, wherein said directing step includes conveying the second stream substantially at right angles to said first path.

7. The method of claim 1, further comprising the step of moisturizing the stream.

8. The method of claim 7, wherein said moisturizing step includes contacting the stream with steam.

9. The method of claim 7, wherein said establishing step includes sterilizing atmospheric air and said sterilizing step precedes said moisturizing step.

10. Apparatus for insulating from the surrounding atmosphere a selected area which is occupied by a part of or the entire body of a patient on an operating table, comprising means for establishing a stream of clean-room air between the selected area and the surrounding atmosphere; and means for bundling and confining the stream by thermal stabilization including means for maintaining the temperature of the stream below that of air in the surrounding atmosphere without appreciably influencing the temperature in the selected area, said establishing means including means for conveying the stream along a predetermined path substantially tangentially of the selected area.

11. The apparatus of claim 10, wherein said establishing means comprises a housing having an outlet for clean-room air, said outlet being sterilizable in an autoclave.

12. The apparatus of claim 10, wherein said means for maintaining the temperature of the stream below that of air in the surrounding atmosphere comprises means for cooling the stream.

13. The apparatus of claim 10, wherein said means for maintaining the temperature of the stream below that of air in the surrounding atmosphere comprises means for cooling the stream.

14. The apparatus of claim 10, wherein said bundling and confining means includes means for influencing the temperature of the stream in a predetermined portion of said path.

15. The apparatus of claim 14, wherein said conveying means comprises means for drawing atmospheric air into said path and said bundling and confining means further comprises means for sterilizing the thus drawn atmospheric air in a predetermined portion of said path.

16. The apparatus of claim 10, wherein said bundling and confining means comprises at least one heat exchanger.

17. The apparatus of claim 16, wherein said heat exchanger comprises a tubular component having an external surface which is contacted by the stream and means for conveying a conditioning fluid through said tubular member.

18. The apparatus of claim 10, wherein said bundling and confining means comprises a refrigerating system with a compressor, a condenser and a supply of refrigerant which expands in response to exchange of heat with the stream.

19. The apparatus of claim 18, further comprising means for withdrawing heat from the refrigerant.

20. The apparatus of claim 10, wherein said bundling and confining means comprises a tubular component which contains copper and is contacted by the stream.

21. The apparatus of claim 10, further comprising means for diverting at least a portion of said stream in a predetermined direction.

22. The apparatus of claim 21, wherein said diverting means comprises means for directing at least one secondary stream of air against the stream of clean-room air.

23. The apparatus of claim 21, wherein said diverting means comprises means for directing several secondary streams against the stream of clean-room air in the region of said selected area.

24. The apparatus of claim 23, wherein said directing means forms part of an operating table.

25. The apparatus of claim 10, wherein said establishing means comprises means for sterilizing atmospheric air and said stabilizing means is arranged to influence the temperature of sterilized air.

26. The apparatus of claim 10, wherein said establishing means comprises a distributor which can be sterilized in an autoclave.

27. The apparatus of claim 10, wherein said establishing means includes at least one conduit which can be sterilized in an autoclave.

28. The apparatus of claim 10, wherein said establishing means comprises at least one filter which is arranged to sterilize atmospheric air and which can be sterilized in an autoclave.

29. The apparatus of claim 10, wherein said establishing means includes a housing and a filter in said housing, said filter being arranged to sterilize atmospheric air which is caused to pass therethrough and being removably and replaceably installed in said housing.

30. The apparatus of claim 10, wherein said establishing means includes at least one conduit, a component which is adjacent to one end of said conduit, and means for separably connecting said end of said conduit to said component, said connecting means comprising a coupling which can be sterilized in an autoclave.

31. The apparatus of claim 10, further comprising means for changing the moisture content of the stream.

32. The apparatus of claim 31, wherein said establishing means comprises a clean-room air generator, a distributor arranged to direct the stream against the selected part, and conduit means connecting said distributor with said generator, said moisture changing means including a portion which is installed in said conduit means.

33. The apparatus of claim 31, wherein said establishing means comprises a clean-room air generator, a distributor having outlet means for said stream, and means for connecting said generator with said distributor, said moisture changing means being installed in said connecting means closely adjacent to said distributor.

34. The apparatus of claim 31, wherein said moisture changing means comprises a steam chamber and said establishing means comprises means for conveying the stream through said chamber.

* * * * *